US011528550B2

(12) United States Patent
Dory et al.

(10) Patent No.: US 11,528,550 B2
(45) **Date of Patent: *Dec. 13, 2022**

(54) SELF-COOLING HEADSET

(71) Applicant: Hewlett-Packard Development Company, L.P., Spring, TX (US)

(72) Inventors: Jon R Dory, Fort Collins, CO (US); James Glenn Dowdy, Fort Collins, CO (US); David H Hanes, Fort Collins, CO (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/346,274

(22) Filed: Jun. 13, 2021

(65) Prior Publication Data

US 2021/0306737 A1 Sep. 30, 2021

Related U.S. Application Data

(63) Continuation of application No. 16/480,949, filed on Jul. 25, 2019, now Pat. No. 11,070,905.

(51) Int. Cl.
*H04R 1/10* (2006.01)

(52) U.S. Cl.
CPC ..... *H04R 1/1075* (2013.01); *H04R 1/1008* (2013.01); *H04R 1/1091* (2013.01)

(58) Field of Classification Search
CPC .. H04R 1/1008; H04R 9/022; H05K 7/20127; A61F 11/14
See application file for complete search history.

(56) References Cited

U.S. PATENT DOCUMENTS 6,856,690 B1 2/2005 Skulley
9,621,979 B2 * 4/2017 Bakalos ..... H04R 1/1083
9,664,660 B2 * 5/2017 Lloyd ..... G01N 33/0016
9,860,660 B1 * 1/2018 Bosscher ..... H04R 3/007
(Continued)

FOREIGN PATENT DOCUMENTS

CN 101494811 A 7/2009
CN 201528417 7/2010
(Continued)

OTHER PUBLICATIONS

Sennheiser PC 363D headset review, 2013, http://www.trustedreviews.com/sennheiserpc363dreview, accessed Nov. 7, 2016, 20 pgs.
(Continued)

*Primary Examiner* — Ryan Robinson
(74) *Attorney, Agent, or Firm* — HP Inc. Patent Department

(57) ABSTRACT

In an example implementation, a self-cooling headset includes an ear cup to form an ear enclosure when placed over a user's ear. A first check valve on the ear cup is to open and release a volume of air from the ear enclosure when a positive pressure within the ear enclosure overcomes a cracking pressure of the first check valve. A second check valve on the ear cup is to open and admit a volume of air into the ear enclosure when a partial vacuum within the ear enclosure causes an external pressure to overcome a cracking pressure of the second check valve.

12 Claims, 3 Drawing Sheets

(56) References Cited

U.S. PATENT DOCUMENTS

| | | | | |
|---|---|---|---|---|
| 9,942,647 | B2 * | 4/2018 | Di Censo | G05D 23/00 |
| 10,045,461 | B1 * | 8/2018 | Boozer | H04R 1/00 |
| 10,536,763 | B2 * | 1/2020 | Slater | H04R 1/1041 |
| 2003/0118196 | A1 * | 6/2003 | Woolfork | H04R 1/1091 381/74 |
| 2009/0226023 | A1 | 9/2009 | Akino | |
| 2009/0232340 | A1 * | 9/2009 | Yang | H04R 1/2811 381/371 |
| 2010/0296682 | A1 * | 11/2010 | Palmer | H04R 25/00 381/332 |
| 2011/0268290 | A1 * | 11/2011 | Lee | H04R 1/1091 381/74 |
| 2015/0281827 | A1 | 10/2015 | Burgett et al. | |
| 2020/0154193 | A1 * | 5/2020 | Hanes | H04R 1/1033 |

FOREIGN PATENT DOCUMENTS

| | | | | | |
|---|---|---|---|---|---|
| CN | 203387652 | | | 1/2014 | |
| CN | 204741543 | | | 11/2015 | |
| CN | 205408108 | | | 7/2016 | |
| CN | 106101895 | | | 11/2016 | |
| JP | 10-148181 | A | | 6/1998 | |
| JP | 2006203666 | A | * | 8/2006 | |
| RU | 1784234 | | | 12/1992 | |
| RU | 1801438 | | | 3/1993 | |
| WO | WO-2009113751 | | | 9/2009 | |
| WO | WO-2009113751 | A | * | 9/2009 | H04R 1/1091 |
| WO | WO-2019/151988 | | | 8/2019 | |
| WO | WO-2019151988 | A1 | * | 8/2019 | H04R 1/1008 |

OTHER PUBLICATIONS

Sennheiser PC 363D, Surround Sound PC Gaming Headset and Microphone, 2013, http://en-uk.sennheiser.com/pc-363d-surround-sound-gaming-headset, accessed Nov. 7, 2016, 16 pgs.

* cited by examiner

SELF-COOLING HEADSET

CROSS REFERENCE TO RELATED APPLICATIONS

This application is a continuation of U.S. application Ser. No. 16/480,949, filed Jul. 25, 2019, which is a 371 application of PCT Application No. PCT/US2017/014798, filed Jan. 25, 2017. The contents of both U.S. application Ser. No. 16/480,949 and PCT Application No. PCT/US2017/014798 are incorporated herein by reference in their entirety.

BACKGROUND

Audio headsets, headphones, and earphones generally comprise speakers that rest over a user's ears to help isolate sound from noise in the surrounding environment. While the term "headset" is sometimes used in a general way to refer to all three of these types of head-worn audio devices, it is most often considered to denote an ear-worn speaker or speakers combined with a microphone that allows users to interact with one another over telecom systems, computer systems, gaming systems, and so on. As used herein, the term "headset" is intended to refer to head-worn audio devices with and without a microphone. The term "headphones" can refer more specifically to a pair of ear-worn speakers with no microphone that allow a single user to listen to an audio source privately. Headsets and headphones often comprise ear cups that fully enclose each ear within an isolated audio environment, while earphones can fit against the outside of the ear or directly into the ear canal.

BRIEF DESCRIPTION OF THE DRAWINGS

Examples will now be described with reference to the accompanying drawings, in which.

Throughout the drawings, identical reference numbers designate similar, but not necessarily identical, elements.

DETAILED DESCRIPTION

Figure 1:
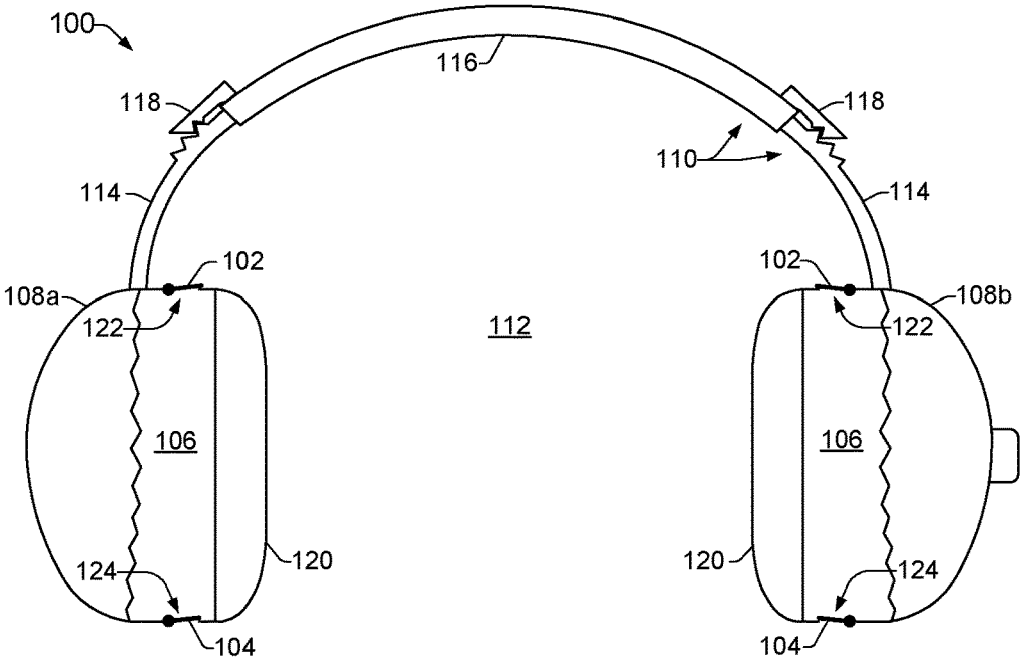
FIG. 1 shows an example of a self-cooling headset in which a first check valve and a second check valve enable active circulation of fresh air through an ear enclosure of an ear cup.

Users who wear headsets, headphones, and other head-worn audio devices for extended periods of time can experience various types of discomfort. For example, users can experience ear pain from ill-fitting ear cups, pain in the temples from ear cups pressing against eyeglasses, general headaches from ear cups that press too tightly against the user's head, and so on. Another discomfort users often complain about is having hot ears. Gamers, for example, often use headsets for extended periods of time which can lead to increases in temperature within the ear cups and around the ears where the headset cushions press against their head. As a result, many gamers and other users often complain that their ears get hot, sweaty, itchy, and generally uncomfortable.

Headsets are generally designed so that the ear cups press hard enough against a user's head to fully enclose each ear and to provide an audio environment favorable for producing quality sound from an incoming audio signal while blocking out unwanted noise from the ambient environment. Maintaining user comfort while providing such an audio environment can be challenging, especially during periods of extended use. In some examples, headsets can include features that help to alleviate discomforts such as the increases in temperature associated with extended use. In some examples, headsets have been designed to include a fan or fans to actively move air into and out of the enclosed areas surrounding the user's ears. In some examples, headsets have been designed to include open vents that enable a passive circulation of air into and out of the enclosed areas surrounding the user's ears. In some examples, headsets have been designed with ear cushions comprising materials capable of conducting heat away from the user's ears. Such designs can help to alleviate the increases in temperature associated with the extended use of headsets, but they can add considerable cost to the product while providing minimal relief.

Accordingly, in some examples described herein, a self-cooling headset uses the motion of the speaker transducer in combination with entry and exit ports within each ear cup to provide active cooling of the enclosed areas surrounding a user's ears. The speaker transducer refreshes air within the ear cup enclosure (i.e., the ear cup volume) by forcing air out of the enclosure through an exit port in a first or forward motion, and by drawing air into the enclosure through an entry port in a second or reverse motion. The first or forward motion of the speaker transducer causes a positive pressure within the ear enclosure. A first check valve installed at the exit port opens to let air out of the enclosure when the positive pressure caused by the speaker transducer overcomes the cracking pressure of the valve. The second or reverse motion of the speaker transducer causes a negative pressure within the ear enclosure. A second check valve installed at the entry port opens to let ambient air into the enclosure when a negative pressure caused by the speaker transducer overcomes the cracking pressure of the valve. The first and second check valves are installed in the ear cup in opposite orientations so that a positive pressure within the cup opens the first valve while sealing closed the second valve, and a negative pressure within the cup opens the second valve while sealing closed the first valve.

In a particular example, a self-cooling headset includes an ear cup to form an ear enclosure when placed over a user's ear. A first check valve on the ear cup is to open and release a volume of air from the ear enclosure when a positive pressure within the ear enclosure overcomes a cracking pressure of the first check valve. A second check valve on the ear cup is to open and admit a volume of air into the ear enclosure when a partial vacuum within the ear enclosure causes an external pressure to overcome a cracking pressure of the second check valve.

In another example, a method of self-cooling a headset includes installing a first valve in an exit port of an ear cup to release air from an ear cup volume. The method also includes installing a second valve in an entry port of the ear cup to admit air into the ear cup volume. In the method, a receiver is also installed to receive audio signals to drive a speaker cone in a forward direction to create a positive pressure within the ear cup volume and in a reverse direction to create a vacuum within the ear cup. The positive pressure is to open the first valve and the vacuum is to open the second valve.

In another example, a self-cooling headset includes an ear cup to form an ear enclosure when placed over a user's ear. An exit port and an entry port are formed in the ear cup. The headset includes a first check valve at the exit port to enable air to escape from the ear enclosure through the exit port upon opening, and a second check valve at the entry port to enable air to enter the ear enclosure through the entry port upon opening.

FIG. 1 shows an example of a self-cooling headset 100 in which a first check valve 102 and a second check valve 104 enable active circulation of fresh air through the ear enclosure 106 of an ear cup 108. As discussed, described, illustrated, referred to, or otherwise used herein, a "check valve" is intended to encompass any of a wide variety of valves, controllers, regulators, stopcocks, spigots, taps, or other devices that are capable of functioning as non-return-type valve devices that can enable air flow in a forward or first direction and prevent air flow in a backward or second direction. In some examples, such a valve device may include devices that employ alternate opening mechanisms such as sliding mechanisms that slide across an aperture to expose a port (e.g., 122, 124) or opening in the ear cup 108, different intersecting port shapes formed in the ear cup 108 that provide static openings, and so on. Thus, while the term "check valve" is used throughout this description, other similarly functional devices of all types are possible and are contemplated herein for use as or within any examples. The headset 100 can include an ear cup 108 for each ear (i.e., illustrated in the figures as two ear cups 108*a*, 108*b*). In FIG. 1 and in other figures throughout this description, the ear cups 108 are shown in partial transparency in order to better illustrate details of the ear enclosure 106 area and additional components within the ear cup 108.

Figure 2:
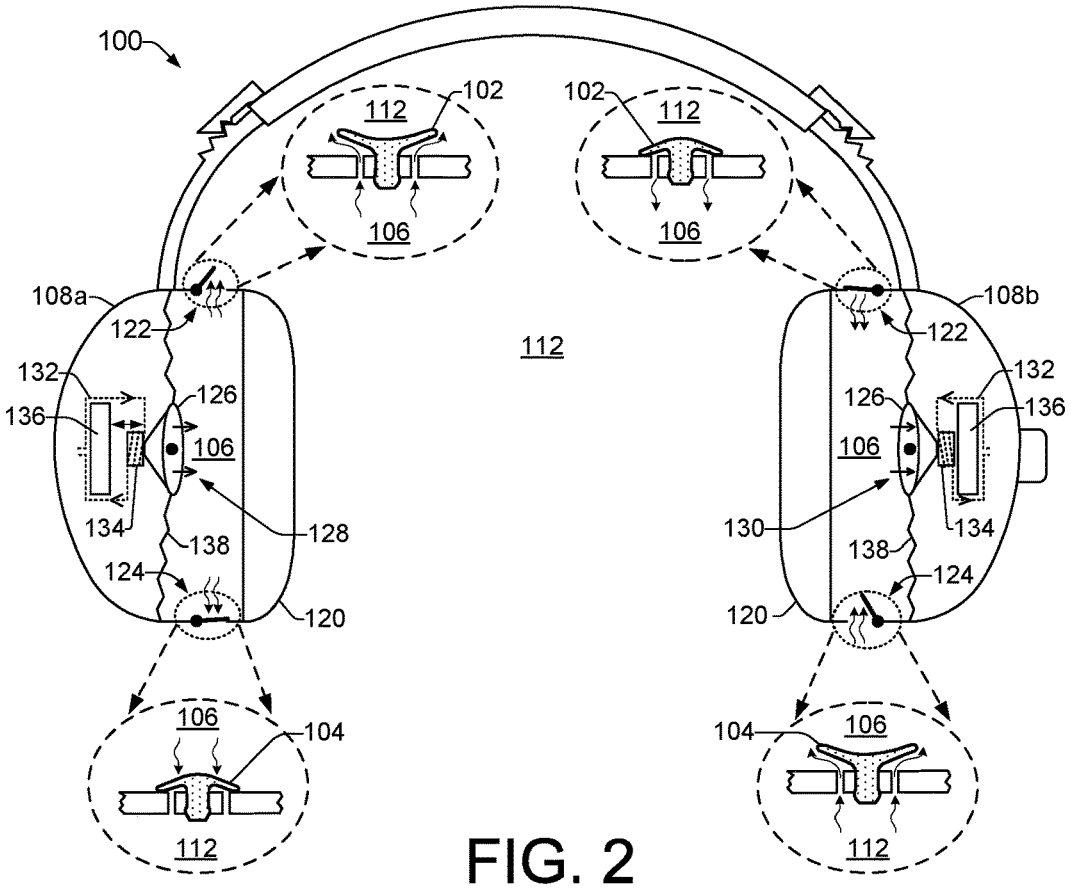
FIG. 2 shows an example of a self-cooling headset with additional details to illustrate an example construction and operation of the headset.

FIG. 2 shows an example of a self-cooling headset 100 with additional details illustrated to facilitate further discussion of an example construction and operation of the headset 100. Referring to FIGS. 1 and 2, the ear cups 108 to be worn over a user's ears can be connected by a head piece 110. The head piece 110 can be adjustable to accommodate users of varying ages and head sizes. The head piece 110 can be adjustable to firmly secure each ear cup 108 against a user's head in a manner that provides an ear enclosure 106 that is isolated from the ambient environment 112 outside of the ear cup 108. Greater isolation of the ear enclosure 106 area from the ambient environment 112 can provide an improved audio experience for the user. The head piece 110 can be adjustable, for example, with extendable and retractable end pieces 114 that telescope from a center piece 116 and latch into different positions with a latching mechanism 118. Cushions 120 can be attached to each ear cup 108 to help provide comfort for the user and to improve isolation of the ear enclosure 108 from the ambient environment 112. Cushions 120 can be formed, for example, from soft rubber, foam, foam-rubber, and so on.

As noted above, first and second check valves, 102 and 104, enable active circulation of fresh air through the ear enclosure 106 of ear cups 108. In some examples, check valves can be installed in ports that are formed in the ear cup 108. Such ports can provide passage ways for air to travel from the outside ambient environment 112 into the ear enclosure 106 and back into the ambient environment 112 from the enclosure 106. The first check valve 102, for example, can be installed in an exit port 122 of the ear cup 108 to enable air from within the ear enclosure 106 to exit the enclosure 106 when the first check valve 102 opens. The second check valve 104 can be installed in an entry port 124 of the ear cup 108 to enable fresh air from the ambient environment 112 to enter the ear enclosure 106 when the second check valve 104 opens. In some examples, air within the ear enclosure 106 can be warm air that has been heated due to its close proximity to a user's ear and its confinement within the limited area of the ear enclosure 106. Active movement of warm air out of the ear enclosure 106 through an exit port 122 coupled with active movement of fresh air into the ear enclosure 106 through an entry port 124 can help to maintain user comfort. In some examples, as shown in FIG. 2, the exit port 122 is located toward the top of the ear cup 108 and the entry port 124 is located toward the bottom of the ear cup 108 to facilitate the removal of warm air from the ear enclosure 106 as it naturally rises within the enclosure 106. In other examples, the locations of the exit port 122 and entry port 124 on the ear cup 108 can be reversed such that the exit port 122 is located toward the bottom and the entry port 124 is located toward the top. In other examples, the exit port 122 and entry port 124 can be located at various different positions around the ear cup 108.

The first and second check valves, 102 and 104, can open and close to allow air to pass into and out of the ear enclosure 106 based on the valve orientations and based on a differential pressure between the volume of air within the ear enclosure 106 and the air in the ambient environment 112. As shown in FIG. 2, for example, the first check valve 102 comprises an outward oriented (i.e., outward opening) check valve that can open in a single outward direction to enable air to escape from the ear enclosure 106 through the exit port 122 and into the ambient environment 112. The first check valve 102 has an associated cracking pressure that indicates a minimum opening pressure that will cause the check valve to open in the single outward direction, as indicated in the left ear cup 108*a* of FIG. 2 by small wavy arrows pointing in a direction from inside the ear enclosure 106 to the ambient environment 112 outside of the ear cup 108*a*. Thus, when pressure within the ear enclosure 106 overcomes the cracking pressure of the first check valve 102, the first check valve 102 opens outward and allows air to escape from within the ear enclosure 106 and pass through the exit port 122 into the ambient environment 112. When the pressure within the ear enclosure 106 falls below the cracking pressure of the first check valve 102, the valve 102 closes. As noted above, a "check valve" as used throughout this description is intended to encompass other similarly functional devices of all types that are capable of functioning as non-return-type valve devices. Thus, a "cracking pressure" as used herein is intended to refer to and generally apply to any such devices as an "opening pressure" that is sufficient to begin to open any such device.

Similarly, but in an opposite way, the second check valve 104 comprises an inward oriented (i.e., inward opening) check valve that can open in a single inward direction to enable air to enter the ear enclosure 106 from the ambient environment 112 through the entry port 124. The second check valve 104 has an associated cracking pressure that indicates a minimum opening pressure that will cause the check valve to open in the single inward direction. This is shown in the right ear cup 108*b* of FIG. 2 by small wavy arrows pointing in a direction from the ambient environment 112 outside of the ear cup 108*b* and into the ear enclosure 106. Thus, when a partial vacuum or negative pressure within the ear enclosure 106 (i.e., negative pressure relative to the outside ambient environment 112) overcomes the cracking pressure of the second check valve 104, the second check valve 104 opens inward and allows fresh air from the ambient environment 112 to pass through the entry port 124 and into the ear enclosure 106. When the partial vacuum or negative pressure within the ear enclosure 106 falls below the cracking pressure of the second check valve 104, the valve 104 closes.

The first and second check valves, 102 and 104, operate in an opposing manner with respect to one another. More specifically, while a positive pressure within the ear enclosure 106 acts to open the first check valve 102, as discussed above, it simultaneously acts to force the second check valve 104 closed. Similarly, while a partial vacuum or negative pressure within the ear enclosure 106 acts to open the second check valve 104, it simultaneously acts to force the first check valve 102 closed. In some examples, the cracking pressure of the first and second check valves can be the same pressure, while in other examples, the first and second check valves may have cracking pressures that are different from one another.

Figure 3:
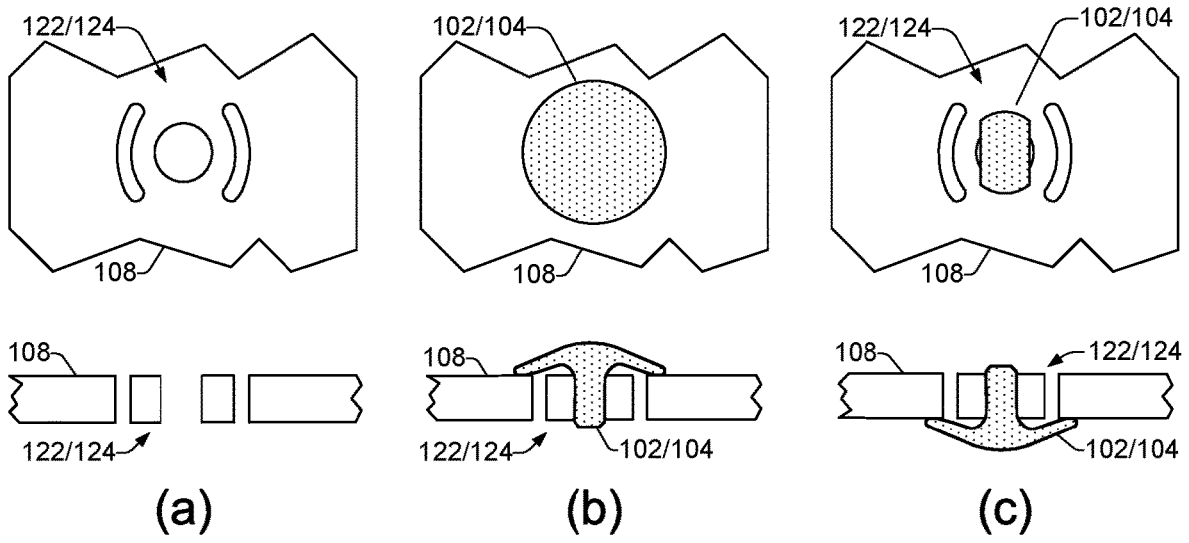
FIG. 3 shows an example of how an example umbrella check valve may be implemented within an entry and exit port of an ear cup 108.

In different examples, the check valves 102 and 104 can be implemented using different types of check valves. Different types of check valves that may be appropriate include diaphragm check valves, umbrella check valves, ball check valves, swing check valves, lift-check valves, in-line check valves, and combinations thereof. Thus, while check valves 102 and 104 are illustrated herein as being umbrella check valves, other types of check valves that can open to permit air to flow in a first direction and close to prevent air from flowing in an opposite direction are possible and are contemplated herein. FIG. 3 shows a more detailed view of how an example umbrella check valve may be implemented within an entry and exit port 122/124 of an ear cup 108. FIG. 3*a* illustrates a top down view and a side view of an example entry or exit port 122/124 formed in the surface of an ear cup 108 that is suitable to accommodate an umbrella check valve. The example port includes a circular hole into which the valve of an umbrella check valve can be seated, and two passages through the ear cup 108 surface that enable air to pass between the ear enclosure 106 and the ambient environment 112. FIG. 3*b* illustrates a top down view and a side view of an example umbrella check valve 102/104 whose valve stem is seated in the port with the check valve closed over the two air passages of the port. FIG. 3*c* illustrates a bottom up view and a side view of an example umbrella check valve 102/104 whose valve stem is seated in the port with the check valve closed over the two air passages of the port.

Referring again generally to FIG. 2, pressure differentials between air within the ear enclosure 106 and the ambient environment 112 that can open the first check valve 102 and second check valve 104 can be generated by movement of a speaker cone 126. The ear enclosure 106 can be generally defined as the open space or volume between a user's ear and the speaker cone 126. In some examples the speaker cone 126 can be supported within the ear cup 108 by a "surround" 138 that flexibly attaches the cone 126 to an outer frame or "basket" of the ear cup 108. Thus, the surround 138 in combination with the speaker cone 126 can define the space or volume of the ear enclosure 106.

During operation, the speaker cone 126 can translate in a forward direction 128 as shown in ear cup 108*a*, and in a reverse direction 130 as shown in ear cup 108*b*. Components of a speaker transducer that generate the forward and reverse motions of the speaker cone 126 include a voice coil 132 wrapped around a coil-forming cylinder 134. During operation, incoming electrical signals traveling through the coil 132 turn the coil 132 into an electromagnet that attracts and repels a permanent/stationary magnet 136. Attraction and repulsion of the magnet 136 by the coil 132 causes movement of the coil 132 and the speaker cone 126 in a forward and reverse direction according to the incoming electrical signals.

In some examples, the incoming electrical signals comprise audio signals that drive the speaker cone 126 to create sound within the ear enclosure 106. In some examples, the incoming electrical signals can drive the speaker cone 126 in forward and reverse directions without creating sound within the ear enclosure 106. Thus, there is no intent to limit the nature of incoming electrical signals that can drive the speaker cone 126. Whether sound is created within the ear enclosure 106 or not, incoming electrical signals can drive the speaker cone 126 to create pressure changes within the ear enclosure 106 that are sufficient to cause opening and closing of the first and second check valves, 102 and 104, in a manner as generally described herein above. More specifically, when the speaker cone 126 translates or moves in a forward direction 128 as shown in ear cup 108*a*, it can generate a positive pressure within the ear enclosure 106 that overcomes the cracking pressure of the first check valve 102, which causes the valve 102 to open and release air from the ear enclosure 106 into the ambient environment 112. Similarly, but oppositely, when the speaker cone 126 translates or moves in a reverse direction 130 as shown in ear cup 108*b*, it can create a partial vacuum or negative pressure within the ear enclosure 106 (i.e., a negative pressure differential between the ear enclosure 106 and ambient environment 112) that can overcome the cracking pressure of the second check valve 104, which causes the valve 104 to open and admit fresh air from the ambient environment 112 into the ear enclosure 106.

Figure 4:
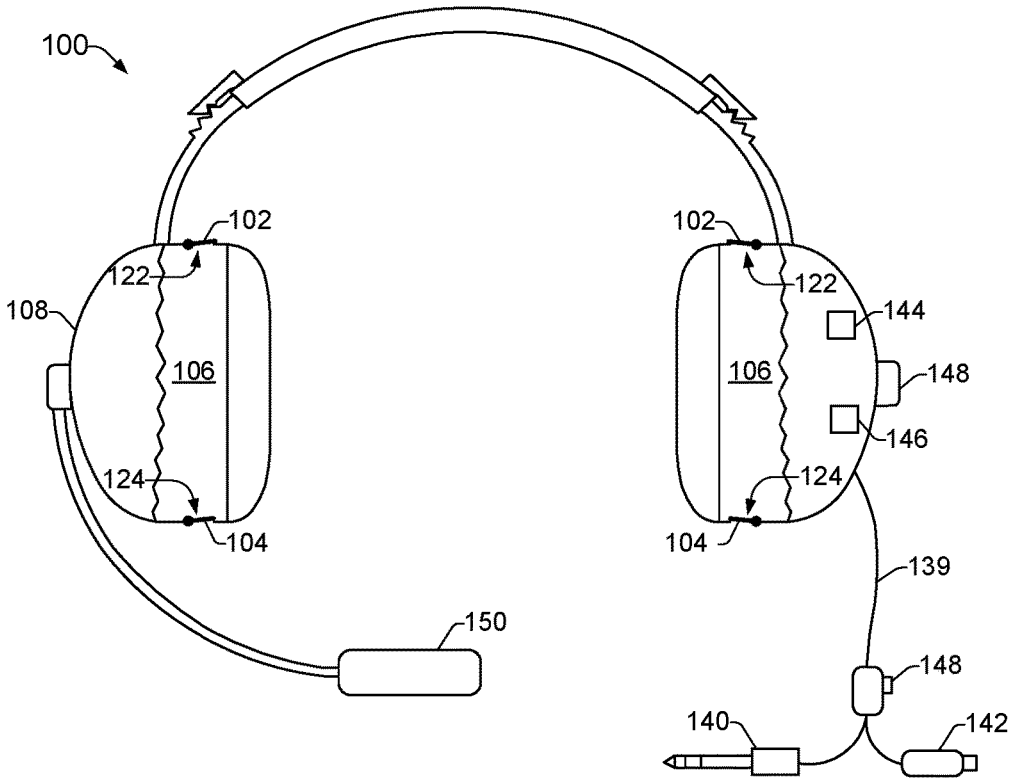
FIG. 4 shows an example of a self-cooling headset that illustrates alternate operating modes for the headset.

FIG. 4 shows an example of a self-cooling headset 100 that illustrates alternate operating modes for the headset 100. In some examples, a headset 100 can include an audio cable 139 to receive power and audio signals from an audio source, such as a stereo system, a gaming system, or a computer system (not shown). The audio cable 139 can include an audio jack 140 and/or USB plug 142 to plug into the audio source. Thus, an audio cable 139 with an audio jack 140 and/or USB plug 142 can act as a wired audio signal receiver and power receiver. In some examples a self-cooling headset 100 can comprise a wireless headset powered by batteries or a battery pack 144, and receiving audio signals through an onboard wireless receiver 146. A wireless receiver 146 can be implemented, for example, as a Bluetooth receiver, a zigbee receiver, a z-wave receiver, a near-field-communication (nfc) receiver, a wi-fi receiver, and an RF receiver. In some examples, a control 148 can be positioned on the audio cable 139 or on an ear cup 108. A control 148 can be used, for example, to adjust audio volume and select between different audio signals coming through the audio jack 140 and USB plug 142. In some examples, a self-cooling headset 100 can include a microphone 150 coupled to an ear cup 108. Computer gaming headsets often include a microphone to enable interaction between players.

Figure 5:
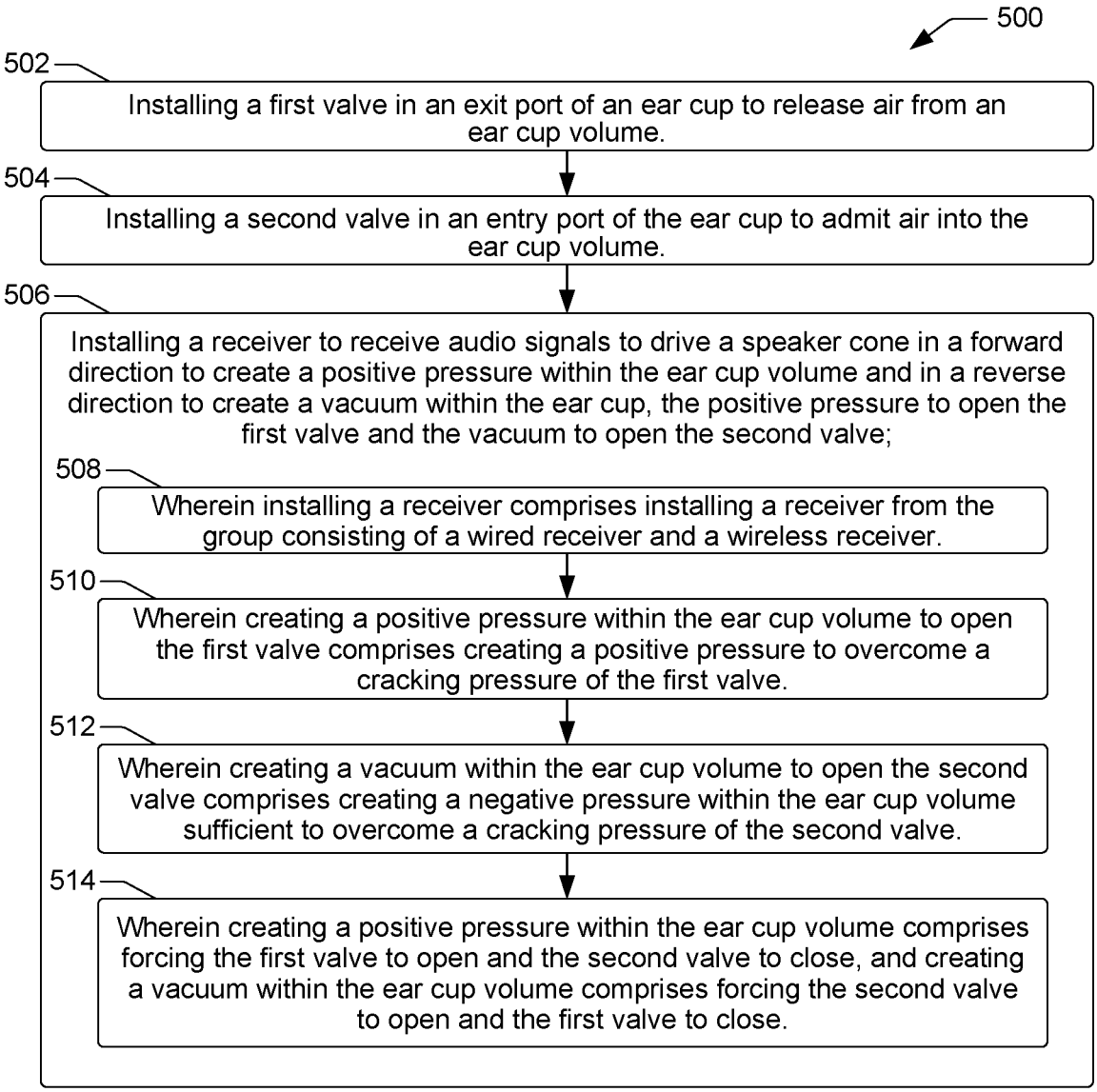
FIG. 5 shows a flow diagram of an example method of self-cooling a headset using the motion of a speaker cone and entry and exit ports gated by check valves.

FIG. 5 shows a flow diagram of an example method 500 of self-cooling a headset using the motion of a speaker cone and entry and exit ports gated by check valves. The method 500 is associated with examples discussed above with regard to FIGS. 1-4, and details of the operations shown in method 500 can be found in the related discussion of such examples. In some examples, the method 500 may include more than one implementation, and different implementations of method 500 may not employ every operation presented in the flow diagram of FIG. 5. Therefore, while the operations of method 500 are presented in a particular order within the flow diagram, the order of their presentation is not intended to be a limitation as to the order in which the operations may actually be implemented, or as to whether all of the operations may be implemented. For example, one implementation of method 500 might be achieved through the performance of a number of initial operations, without performing one or more subsequent operations, while another implementation of method 500 might be achieved through the performance of all of the operations.

Referring now to the flow diagram of FIG. 5, an example method 500 of self-cooling a headset begins at block 502 with installing a first valve in an exit port of an ear cup to release air from an ear cup volume. As shown at block 504, the method can include installing a second valve in an entry port of the ear cup to admit air into the ear cup volume. The exit and entry ports can enable air to flow into and out of an ear enclosure formed by the ear cup. Further, as shown at block 506, the method 500 can include installing a receiver to receive audio signals to drive a speaker cone in a forward direction to create a positive pressure within the ear cup volume, and in a reverse direction to create a vacuum within the ear cup. The positive pressure is to open the first valve and the vacuum is to open the second valve.

Continuing as shown at block 508, in some examples, installing a receiver comprises installing a receiver from the group consisting of a wired receiver and a wireless receiver. In some examples, creating a positive pressure within the ear cup volume to open the first valve comprises creating a positive pressure to overcome a cracking pressure of the first valve, as shown at block 510. In some examples, creating a vacuum within the ear cup volume to open the second valve comprises creating a negative pressure within the ear cup volume sufficient to overcome a cracking pressure of the second valve, as shown at block 512. As shown at block 514, creating a positive pressure within the ear cup volume can include forcing the first valve to open and the second valve to close, and creating a vacuum within the ear cup volume can include forcing the second valve to open and the first valve to close.

What is claimed is:

1. A self-cooling headset comprising:

an ear cup to form an ear enclosure when placed over a user's ear;

an exit port formed in the ear cup toward a top side of the ear cup to facilitate removal of warm air that rises within the ear cup by natural convection and an entry port formed in the ear cup toward a bottom side of the ear cup;

a first check valve with a first cracking pressure at the exit port to enable air to escape from the ear enclosure through the exit port when opened; and, a second check valve with a second cracking pressure different than the first cracking pressure at the entry port to enable air to enter the ear enclosure through the entry port when opened.

2. A self-cooling headset as in claim 1, further comprising:

a speaker cone to generate sound within the enclosure by forward and reverse movements;

wherein a forward movement of the speaker cone creates a positive pressure within the enclosure to open the first check valve while closing the second check valve, and a reverse movement of the speaker cone creates a partial vacuum within the enclosure to open the second check valve while closing the first check valve.

3. A self-cooling headset as in claim 2, wherein opening the first check valve comprises creating a positive pressure within the enclosure to overcome the first cracking pressure and opening the second check valve comprises creating a partial vacuum within the enclosure to overcome the second cracking pressure.

4. A self-cooling headset as in claim 1, further comprising:

a speaker cone to produce positive pressure and negative pressure within the enclosure without generating audible sound by translating in forward and reverse directions in response to a received non-audio signal, the positive pressure to open the first check valve while closing the second check valve, and the negative pressure to open the second check valve while closing the first check valve.

5. A method of self-cooling a headset comprising:

installing a first valve with a first cracking pressure in an exit port located toward a top side of an ear cup to release air from an ear cup volume, the top side location of the exit port to facilitate removal of warm air from within the ear cup by natural convection when the first valve is open;

installing a second valve with a second cracking pressure different than the first cracking pressure in an entry port located toward a bottom side of the ear cup to admit air into the ear cup volume; and, installing a receiver to receive audio signals to drive a speaker cone in a forward direction to create a positive pressure within the ear cup volume and in a reverse direction to create a vacuum within the ear cup, the positive pressure to open the first valve and the vacuum to open the second valve.

6. A method as in claim 5, wherein installing a receiver comprises installing a receiver from the group consisting of a wired receiver and a wireless receiver.

7. A method as in claim 5, wherein creating a positive pressure within the ear cup volume to open the first valve comprises creating a positive pressure to overcome the first cracking pressure of the first valve.

8. A method as in claim 5, wherein creating a vacuum within the ear cup volume to open the second valve comprises creating a negative pressure within the ear cup volume sufficient to overcome the second cracking pressure of the second valve.

9. A method as in claim 5, wherein:

creating a positive pressure within the ear cup volume comprises forcing the first valve to open and the second valve to close; and, creating a vacuum within the ear cup volume comprises forcing the second valve to open and the first valve to close.

10. A self-cooling headset comprising:

an ear cup having an exit port and an entry port and forming an ear enclosure when placed over a user's ear;

a first check valve with a first cracking pressure installed in the exit port to open and release a volume of air from the ear enclosure through the exit port when a positive pressure within the ear enclosure overcomes the first cracking pressure;

a second check valve with a second cracking pressure different from the first cracking pressure installed in the entry port to open and admit a volume of air into the ear enclosure through the entry port when a negative pressure within the ear enclosure overcomes the second cracking pressure; and, a speaker cone to produce the positive pressure and the negative pressure without generating audible sound by translating in forward and reverse directions in response to a received non-audio signal.

11. A self-cooling headset as in claim 10, wherein forward translation of the cone produces the positive pressure to overcome the cracking pressure of the first check valve and reverse translation of the cone produces the negative pressure to overcome the cracking pressure of the second check valve.

12. A self-cooling headset as in claim 10, wherein the exit port is located toward a top side of the ear cup and the entry port is located toward a bottom side of the ear cup, the locations of the exit port and entry port to facilitate removal of warm air from the ear enclosure by natural convection.

* * * * *